US005280853A

United States Patent [19]

Perret, Jr.

[11] Patent Number: 5,280,853

[45] Date of Patent: Jan. 25, 1994

[54] SINGLE PIECE SPRAY TIP

[75] Inventor: Robert J. Perret, Jr., Costa Mesa, Calif.

[73] Assignee: ASM Company, Inc., Orange, Calif.

[21] Appl. No.: 961,448

[22] Filed: Oct. 15, 1992

[51] Int. Cl.[5] ..... B05B 15/02

[52] U.S. Cl. ..... 239/119; 239/288.3; 239/600

[58] Field of Search ..... 239/119, 288.3, 600; 137/239; 251/172

[56] References Cited

U.S. PATENT DOCUMENTS

| | | | |
|---|---|---|---|
| 4,116,386 | 9/1978 | Calder | 239/119 |
| 4,165,836 | 8/1979 | Eull | 239/119 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,516,724 | 5/1985 | Hellman | 239/119 |
| 4,537,355 | 8/1985 | Calder | 239/119 |
| 4,611,758 | 9/1986 | Geberth, Jr. | 239/119 |
| 4,635,850 | 1/1987 | Leisi | 239/119 |
| 4,715,537 | 12/1987 | Calder | 239/119 |
| 4,757,947 | 7/1988 | Calder | 239/119 |
| 4,830,281 | 5/1989 | Calder | 239/119 |

FOREIGN PATENT DOCUMENTS

| | | | |
|---|---|---|---|
| 3513587 | 11/1985 | Fed. Rep. of Germany | 239/119 |
| 2079184 | 1/1982 | United Kingdom | 239/119 |

*Primary Examiner*—Andres Kashnikow
*Assistant Examiner*—Lesley D. Morris
*Attorney, Agent, or Firm*—Plante, Strauss & Vanderburgh

[57] ABSTRACT

The present invention relates to a low-cost, disposable spray tip for airless spraying, which has an orifice tip holder that is reversible between spraying and cleaning positions. The orifice spray tip is mounted in a rotatable member by a retainer threadably engaged in the body. The body includes a through running passage opening at the back and the front of the body and which receives the sealing piston secured in the passage by the retainer. An orthogonal bore opening at the top and the bottom of the body intersects the passage and a cylindrical turret member is permanently but rotatably mounted in the bore. The body and spray guards are formed as a single piece, preferably by die casting or molding, and the through running passage and orthogonal bore are formed concurrently during the molding or die casting operation. The only additional components to be assembled are the retainer and piston seal assembly and the rotatable turret member and handle assembly. The spray tip assembly is retained on the spray gun by a retainer nut which is loosely secured to the body of the spray tip by a shoulder formed by an enlarged head portion on the retainer which acts against an annular flange at one end of the retainer nut.

12 Claims, 2 Drawing Sheets

SINGLE PIECE SPRAY TIP

FIELD OF THE INVENTION

This invention relates to a spray tip for airless spraying and in particular to an inexpensive, disposable spray tip provided with a reversible turret member.

BACKGROUND OF THE INVENTION

In many spray applications in which a liquid under pressure is forced through an orifice of a spray tip assembly, the spray tip assembly is adapted to permit the substitution of different orifice members in order to vary the spray pattern. In many cases the spray tip assembly is supplied with orifices of varying sizes. As an aid for cleaning the spray tip, many spray tips assemblies include a rotatable turret member which carries the orifice member and which can be rotated within a central body to reverse the orifice for cleaning.

In U.S. Pat. No. 3,831,862 a spray tip assembly is disclosed in which the spray tip orifice is mounted in a removable and reversible sleeve which is secured in the housing with a sliding pin interlock that seats against a spring biased seal.

In U.S. Pat. No. 4,116,396 a spray tip assembly is disclosed in which the spray tip orifice is mounted in a cylindrical turret member which can be rotated in the housing to reverse the orifice member for cleaning.

U.S. Pat. No. 4,165,836 discloses a similar type spray tip including a reversible orifice and teaches that the solid plastic seal which seals the rotatable member carrying the orifice exhibits excessive wear and suggests that an entirely metal seal be used to provide metal-to-metal contact between the seal and the turret member.

In a similar vein, U.S. Pat. No. 4,483,481 discloses a spray tip assembly which provides a seal construction to overcome the prior art difficulties with solid plastic seals by providing a metal seal having a thin plastic between the metal sealing member and the turret member.

U.S. Pat. No. 4,635,850 discloses a spray nozzle including a central body, an adaptor for attachment to a spray gun, safety tip attached to the front of the central body. A rotatable cylinder is rotatably mounted in the central body and carries the nozzle and orifice which can be reversed by rotating the cylindrical body. A separate sealing joint comprises several pieces placed between the diffuser of the spray gun and extends through the central body to seal the rotatable cylinder.

The design of the spray tips of the type illustrated in the foregoing U.S. patents contain a substantial number of parts which add to the expense of the manufacture of the spray tip. Consequently, the cost of such spray tips is relatively high and spray tips having replaceable orifices are primarily designed for commercial users who require a variety of orifice sizes and to whom the cost of the spray tips is not a major concern. However, airless spraying is a technique that is becoming increasingly popular for non-commercial uses around the home where interchangability of orifices is not a major concern but where the cost of the spray tip is a factor.

Accordingly it would be desirable to provide a low-cost simple spray tip for airless spraying which has the convenience of the reversible orifice for cleaning but which is economical to manufacture and can be sold at retail at a relatively low cost. In addition it would be desirable to have such a spray tip which can be disposed of when the job is finished.

SUMMARY OF THE INVENTION

The present invention relates to a low-cost, disposable spray tip for airless spraying, which has an orifice tip holder that is reversible between spraying and cleaning positions. The orifice spray tip is mounted in a rotatable turret member which is sealed in the assembly by a piston which is held against the rotatable member by a retainer threadably engaged in the body. The forward end of the piston seal has a seal face formed of a very hard reinforced plastic such as an acetal copolymer reinforced with glass fiber.

The housing includes a through-running passage opening at the back and the front of the body and which receives the sealing piston secured in the passage by the retainer. An orthogonal bore opening at the top and bottom of the body intersects the passage and a cylindrical turret member is permanently but rotatably mounted in the bore. The cylindrical turret member extends beyond the top and bottom of the body and the top extension carries a handle for rotating the turret member and the bottom extension is provided with means for securing the turret member in the bore of the body. The retainer is preferably threaded for engagement with corresponding threads in the passage of the body adjacent the back end thereof. The retainer is provided with a through running bore, a portion of which is counter bored to receive the body of the sealing piston which is preferably retained therein by resilient annular sealing members, preferably plastic O-rings. Preferably the inner end of the threaded portion of the passage in the body is provided with an abutment shoulder, which defines the surface against which the inner end of the retainer abuts when the retainer is received in the through-running passage. This surface insures that the sealing piston carried by the retainer will be perpendicular to the turret member to insure a good seal between the sealing face of the sealing piston and the turret member.

The body and spray guard are formed as a single piece, preferably by die casting or molding, and the through-running passage and orthogonal bore are formed concurrently during the molding or dye casting operation. The only additional components to be assembled are the retainer and piston seal assembly and the rotatable turret member and handle assembly. The spray tip assembly is retained on the spray gun by a retainer nut which is loosely secured to the body of the spray tip by a shoulder formed by an enlarged head portion on the retainer which acts against a annular flange at one end of the retainer nut.

The spray tip assembly of the present invention is inexpensive to manufacture and contains relatively few parts, essentially the retainer and piston seal assembly and the turret member assembly thus keeping the manufacturing cost at a minimum. The spray tip is produced from inexpensive materials so that the retail cost of the spray tip is well within the reach of the average non-professional. Although inexpensive, the spray tip functions in the same manner as the more expensive commercial spray tips having replaceable orifices and the orifice of the spray tip of the present invention can be reversed for cleaning purposes. At the completion of the job the spray tip can be disposed of or can be cleaned and retained for future projects.

These and other advantages and features of the present invention will become apparent from the following detailed description of the preferred embodiments taken in conjunction with the drawings.

DETAILED DESCRIPTION OF THE INVENTION

Figure 1:
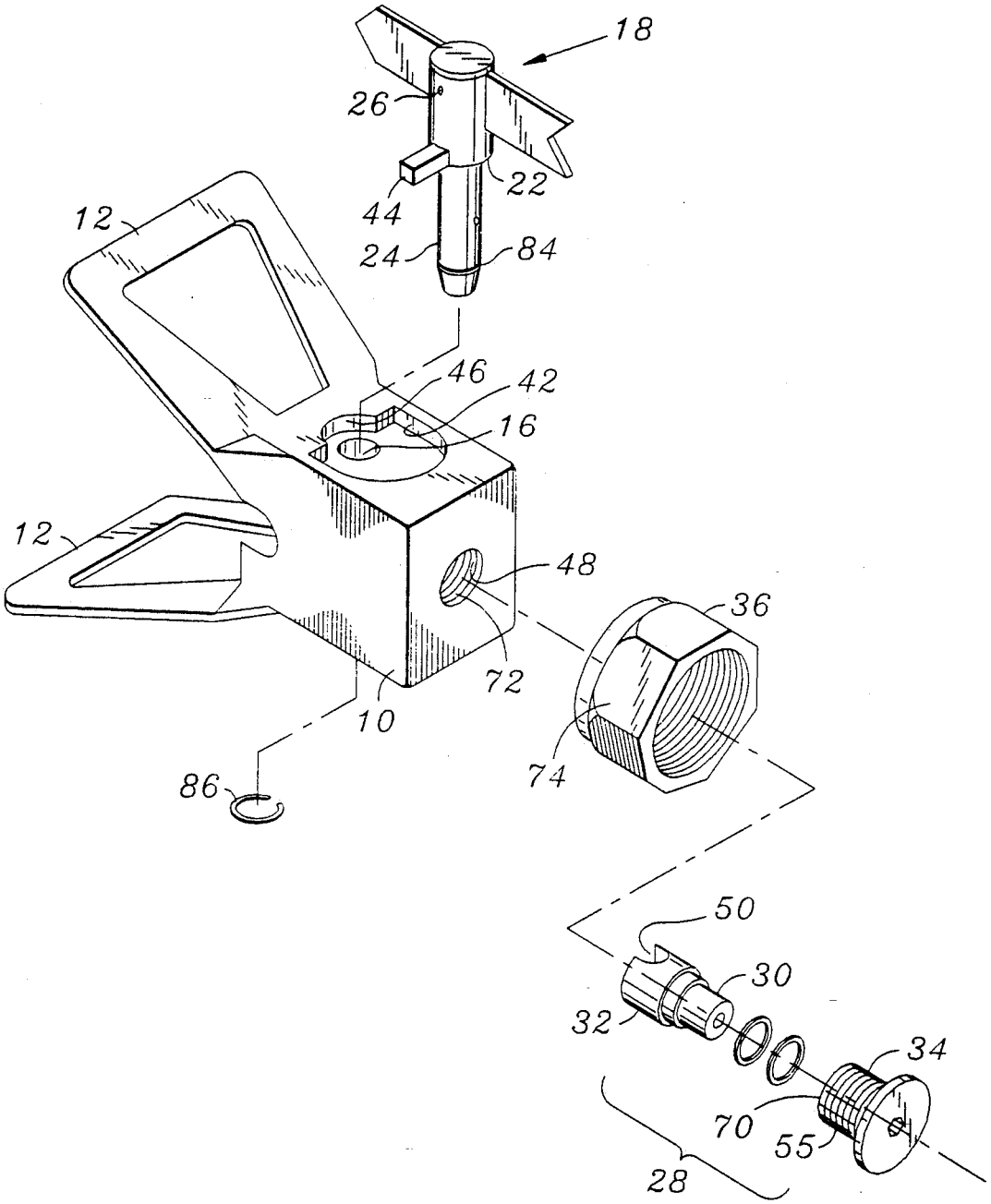
FIG. 1 is an exploded prospective view of the spray tip assembly of the present invention.
Figure 2:
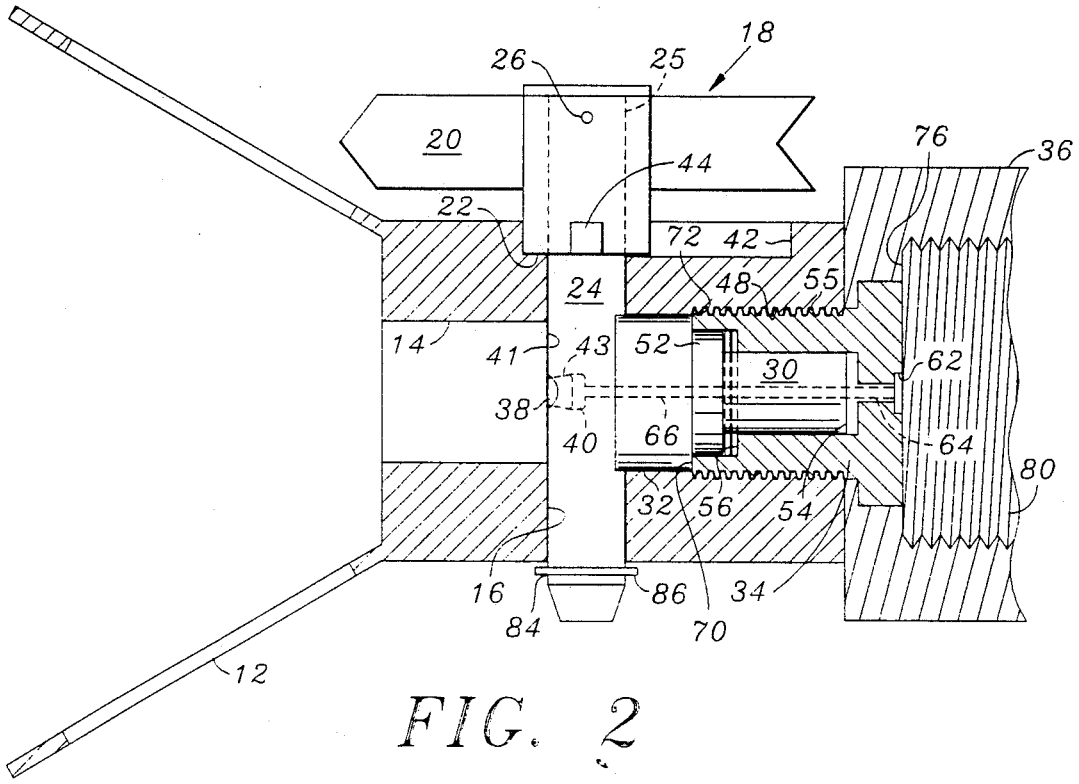
FIG. 2 is a side sectional view of the spray tip assembly of FIG. 1.
Figure 3:
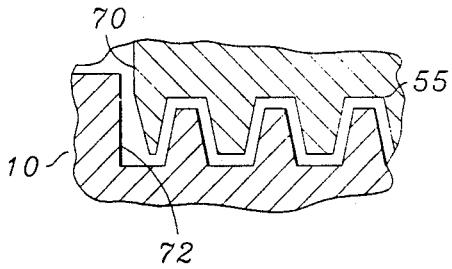
FIG. 3 is a sectional view of a portion of the spray tip assembly of FIG. 2 in enlarged scale.
Figure 4:
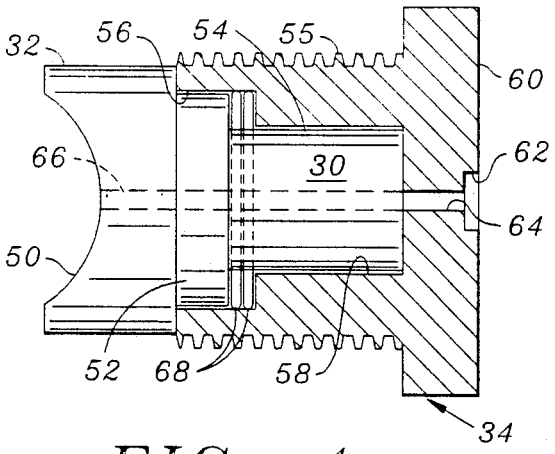
FIG. 4 is a top plan view of the retainer and piston assembly of the spray tip illustrated in FIG. 2.

Referring to the figures, the spray tip assembly of the present invention comprises a body 10 onto which are integrally formed a diverging pair of spray guards 12 at the spray or emission end of the body. A through-running passage 14 extends through the body 10 along its longitudinal axis and an orthogonal bore 16 opens at the top and the bottom of the body 10 and intersects the through-running passage 14. A turret member subassembly 18 is rotatably mounted in the orthogonal bore 16. The subassembly 18 includes a handle 20 which is carried by a handle base 22 which has formed thereon a radially extending projection 44. A turret member 24 depends downwardly from the handle base 22. The upper end of the turret member 24 is received in a socket 25 in the turret base 22 and is secured therein by a transverse pin 26 which extends through the turret handle base and the turret member. A turret seal subassembly 28 is disposed in the passage 14 and includes a piston 30 having a sealing head 32 and a retainer 34 for securing the turret seal subassembly in the passage 14. The assembly is completed by a retainer nut 36 which is also secured to the body 10 by the retainer 34.

The turret member 24 carries a spray tip orifice member 38 in a transverse bore 40. A portion of the transverse bore 40 is enlarged at 41 to receive the orifice member 38 so that the orifice member does not extend beyond the cylindrical surface of the turret member 24.

The upper surface of the body 10 is provided with an aperture 42 for receiving a portion of the handle base 22 when the turret subassembly 18 is disposed in the orthogonal bore 16. The aperture 42 has a notch 46 which defines a stop against the projection 44 to limit rotation of the turret member 24 as a positive indication of the orientation of the bore 40 and orifice tip 38 in either the spraying position or in the reversed cleaning position.

The through-running passage 14 in the body 10 opens to the front and rear faces of the body and is dimensioned to receive the turret seal subassembly 28. A portion 48 of the passage adjacent its opening at the rear face of the body is threaded for engagement with corresponding threads on the retainer 34 of the turret seal subassembly 28.

The turret seal subassembly 28 includes the piston 30 which carries an enlarged sealing head 32 having a concave face 50 which is configured to provide a continuous mating surface with the cylindrical outer surface of the turret member 24. The sealing head 32 is carried by the cylindrical body of the piston 30. The body of the piston 30 is reduced in diameter at 52 and 54. The retainer 34 includes a cylindrical threaded shaft 55 having a bore 56 and a smaller counter bore 58 for receiving the reduced portions 52 and 54 of the piston 30 respectively. An enlarged head 60 is provided at one end of the retainer 34 and includes a through-running small bore 64 communicating between the counter bore 58 and a centrally located socket bore 62 surrounding the opening of the through-running small bore for receiving the end of an allen type wrench. A bore 66 extends through the piston 30 and communicates at one end with the small bore 64 and opens at its opposite end at the concave face 50 of the sealing head 32. When turret seal subassembly 28 is completed, the bore 66 communicates with the transverse bore 40 of the turret member 24 when the turret member 24 is fully rotated for spraying or oppositely rotated for cleaning the orifice member 38. A pair of resilient members 68 are placed on the portion 54 of the piston 30 to seal the piston at the shoulders defined at the juncture of the portions 52 and 54 of the bore 56 and counter bore 58. In addition the resilient sealing members prevent direct contact between the piston 30 and the retainer 34 at that point and also provide spring action for urging the concave face 50 of the sealing head 32 against the cylindrical contour of the turret member 24. The downstream end of the cylindrical shaft 55 of the retainer 34 is machined to define a flat face 70 which is contiguous with a corresponding flat surface 72 in the body 10. The contiguity of the face 70 and the surface 72 insures that the retainer 34 is not cocked when it is threaded into the passage 14 so that the piston 30 and the sealing head 32 are perpendicular to the axis of rotation of the turret member 24 and the face 50 of the sealing head is uniformly urged against the cylindrical surface of the turret member to insure a positive seal between the face and the turret member.

The retainer nut 36 defines a hexagonal shaped outer surface which provides flat surfaces 74 for grasping with a wrench. The inner end of the retainer nut 36 is inwardly turned to define a radially inwardly extending flange 76 which is disposed between the rear surface of the body 10 and the inner surface of the enlarged head 60 of the retainer 34 for securing the retainer nut 36 on the body when the retainer is threadably engaged in the threaded portion 48 of the passage 14.

As is most clearly shown in FIG, 2. the body 10 is shown attached to the threaded barrel 80 of a spray gun by the retainer nut 34 which is tightened onto the threaded barrel to draw the inner face of the radially inwardly extending flange 76 against the corresponding inner face of the enlarged head 60 of the retainer 34. This also draws the small bore 64 in the retainer head 60 into alignment with the emission end of the spray gun for leading the pressurized stream of paint into the through bore 66 of the sealing piston 30 and the sealing head 32. The turret member 24 is rotatably mounted in the transverse bore 40 in the body 10 and is restricted to 180° of rotation by the limiting action of the shoulders defined by the aperture notch 46 which are engaged when the turret member is either in its cleaning or spraying positions with its transverse bore 40 in alignment with the through bore 66 of the piston 30 and sealing head 32. The turret member 24 is provided at its lower end with a groove 84 in which is disposed an E-clip 86 for permanently securing the turret member 24 in the orthogonal bore 16 of the body 10.

During the spraying operation the piston 30 is forced forward by the line pressure to urge the concave face 50 of the sealing head 32 tightly against the cylindrical surface of the turret member 24 to provide good dynamic sealing at high pressures and with low viscosity fluids.

The relatively simple design of the turret seal subassembly 28 and the integral body 10 eliminates a number of components normally found with spray tip assemblies without sacrificing the convenience of the rotatable turret member such as is found on the more expensive and more complex commercial spray tip assemblies. Orientation of the concave face 50 is ensured by the flat face 70 and corresponding flat surface 72 which are provided at the end of the retainer shaft 55 and at the inner end of the threaded portion 48 of the passage 14. Since the turret member is designed to be nonremovable, once the subassemblies are assembled in the body 10 proper sealing between the cylindrical surface of the turret member 24 and the concave face 50 of the sealing head 32 is assured. Additional components are eliminated by the integrally molded spray guards 12 and body 10 in which the through-running passage 14 and the orthogonal bore 16 are provided during the molding or die casting operation.

The body may be molded from a plastic material or die cast from the lightweight metal alloy. Any of the moldable plastics can be used for this purpose including acetal homopolymer and copolymer, polysulfones, polyphenylene sulfide, polycarbonate, thermoplastic and thermosetting polyimides and Nylon. Aluminum alloys are preferred for use in forming the body by die casting and good results have been achieved utilizing 380 aluminum alloy. The piston 30 and the sealing head 32 are also formed entirely of plastic which is filled from 5 to 50 percent by weight and preferably from 1 to about 30 weight percent of a reinforcement filler. Various plastics can be used for this purpose and preferably an acetal copolymer is preferred because of its hardness and wear resistance. The fillers which can be used for reinforcement include graphite, silicon, alumina powders and fibers reinforcement such as graphite and glass fibers. The acetal copolymer is prepared by the copolymerization of trioane with slight amounts of a comonomer which provides carbon to carbon bonding in the polymer chain, thereby imparting a high degree of thermal stability to the polymer. Glass fibers having lengths from about 0.05 to about 0.25" are preferably used as the filler material.

The resilient O-rings provide., sufficient forward thrust to maintain initial sealing of the concave face 50 against the cylindrical surface of the turret member 24 to prevent leaking of the fluid, even when there is no flow through the orifice tip. When fluid is flowing, sufficient flow pressure is exerted against the end of the piston 30 to insure sealing contact between the concave face 50 and the turret member 24.

From the foregoing it can be seen that the spray tip assembly of the present invention comprises a minimum of subassemblies and component parts. By providing for the nonreplacement of the turret member the simpler design permits good sealing between the piston and the turret member without being concerned that the removal of parts will cause wear and ultimately reduce the effectiveness of the seal and utility of the spray tip assembly. The components of the spray tip assembly are made from inexpensive materials and the simplicity of the design of the spray tip assembly makes assembly a relatively simple matter and reduces the cost of manufacture so that the spray tip assembly can be sold at a price well within the range of the home handyman and the like and permits disposal of the spray tip assembly upon completion of the project. At the same time, however, the convenience of the rotatable member allows the orifice tip to be cleaned to remove particles and the like without the necessity of reassembling the spray tip assembly.

As will be understood by those skilled in the art, various arrangements other than those described in detail in the specification will occur to those persons skilled in the art, which arrangements lie within the spirit and scope of the invention. It is therefore to be understood that the invention is to be limited only to the claims appended hereto.

Having described the invention, I claim:

1. A spray tip comprising:

a. a housing body defining upper, lower, front and rear surfaces, said housing body having a through-running passage extending along the longitudinal axis thereof and an orthogonal bore adjacent said front surface thereof, said orthogonal bore intersecting said through-running passage and opening at said upper and lower surfaces of said housing body, a diverging pair of spray guards integral on said housing body adjacent said front surface thereof;

b. a turret member assembly including a cylindrical turret member rotatably mounted in said orthogonal bore, a transverse bore opening at opposite cylindrical surfaces of said turret member, said bore extending along the axis of said housing body and aligned with said through running passage, an orifice spray tip member disposed in said transverse bore at one opening thereof;

c. turret member sealing means disposed in said through running passage of said housing body, said sealing means including a piston body slidably disposed in said passage, a through running bore extending along the axis of said piston body, an enlarged head at one end of said piston body defining a generally concave sealing face configured to define a surface which bears against the cylindrical surface of said turret member;

d. retainer means consisting of a threaded shaft which is received in said through-running passage of said housing body and an enlarged head on one end thereof, a portion of said through running passage of said housing body being threaded for engaging with corresponding threads on said shaft, the terminus of said threaded portion of said through running passage defining an essentially flat surface and the other end of said threaded shaft opposite said one end defining a corresponding flat surface to provide a positive stop for said threaded shaft in said through running passage to ensure positive sealing of said cylindrical turret member by said sealing face of said piston.

2. The spray tip assembly of claim 1 wherein said turret member assembly further includes a handle base and handle and said turret member depends downwardly from said handle base, a radially extending projection carried by said handle base for engaging stop means on said body for limiting the rotation of said turret member when said transverse bore of said turret member is in alignment with said through bore of said piston.

3. The spray tip assembly of claim 2 wherein the upper surface of said body surrounding the opening of said orthogonal bore is enlarged to define an aperture for receiving a portion of said handle base, said aperture further including a forward extending notch which defines shoulders spaced 180° which act against said projection to stop the rotation of said turret member.

4. The spray tip assembly of claim 1 wherein said threaded shaft includes a small through running bore and a larger diameter counterbore extending through a portion of said shaft from said other end terminating within said shaft and said piston body includes a portion of reduced diameter for being received in said through running bore and a portion of larger diameter for being received in said counterbore of said shaft, the terminus of said counterbore defining a shoulder and at lease one resilient member disposed about the smaller portion of said piston between said shoulder in said shaft and the junction of the larger and smaller portions of said piston thereby to normally urge said sealing face of said piston forward against said turret member.

5. The spray tip assembly of claim 4 wherein said means for securing said spray tip assembly to a source of fluid under pressure consists of a hexagonal nut having a radially inwardly turned flange which defines an opening through which said threaded shaft of said retainer extends and which s smaller than the said enlarged head of said retainer whereby said flange and said enlarged head cooperate to secure said spray tip assembly on the source of pressurized fluid.

6. The spray tip assembly of claim 1 wherein said turret member is permanently affixed in said orthogonal bore.

7. The spray tip assembly of claim 1 wherein said body and said integral spray guards are a single piece.

8. The spray tip assembly of claim 1 wherein said body and said integral spray guards are die cast.

9. A spray tip consisting of:

a. a housing and spray guard having a longitudinal housing through bore with internal threads at one end to provide an internally threaded portion and a smooth walled portion, a flat annular shoulder at the junction of said threaded and smooth walled portions, and a housing orthogonal bore intersecting said smooth walled portion;

b. a turret member subassembly of a cylindrical holder rotationally received within said housing orthogonal bore, said cylindrical holder having a transverse bore aligned with said housing through bore, an orifice tip member fixedly mounted within said transverse bore of said holder, and retainer means fixedly securing said holder in said housing orthogonal bore;

c. a seal retainer comprising an externally threaded shaft threadably received within said threaded portion of said housing through bore and extending with one end exteriorly of said housing, a retainer through bore longitudinally coextensive said retainer, an outwardly radial flange at said one end of said shaft, a flat face and a counterbore on the end of said shaft received within said housing, with said flat face of said retainer stopped against said flat annular shoulder within with said housing;

d. a seal piston having an arcuately concave face at one end sealing engaged against said cylindrical holder and having a reduced diameter opposite end which is slidably received within said counterbore of said seal retainer;

e. resilient means also received within said counterbore to bias said seal piston into said housing, urging its concave face against said cylindrical holder; and f. an internally threaded retainer nut having a inwardly turned flange at one end with said seal retainer received within said retainer nut and captured therein by its annular flange.

10. The spray tip of claim 9 wherein said housing and spray guard are of one-piece with said spray guard comprising angularly diverting wings projecting form the forward end of said housing and integral therewith.

11. The spray tip of claim 9 wherein said retainer means permanently retain said turret member subassembly in said housing through bore.

12. The spray tip of claim 9 wherein said cylindrical body has a radial projection and said housing has a recess in its upper surface to receive said radial projection, with a notch in the wall of said recess that provides shoulders at 180° degree increment which serve as rotational stops for said radial projection and thereby limit the rotation of said cylindrical body to an arc of 180° degrees.

* * * * *